United States Patent [19]

Gardner

[11] 4,239,147

[45] Dec. 16, 1980

[54] HEAVY DUTY PARTITION

[75] Inventor: Jeffrey M. Gardner, Wheaton, Ill.

[73] Assignee: Container Corporation of America, Chicago, Ill.

[21] Appl. No.: 89,044

[22] Filed: Oct. 29, 1979

[51] Int. Cl.[3] ..... B65D 5/48

[52] U.S. Cl. ..... 229/15

[58] Field of Search ..... 229/15, 42

[56] References Cited

U.S. PATENT DOCUMENTS

| | | | |
|---|---|---|---|
| 3,092,300 | 6/1963 | Johnson | 229/42 |
| 4,030,659 | 6/1977 | Gardner | 229/42 X |
| 4,127,304 | 11/1978 | Gardner | 229/15 |
| 4,144,995 | 3/1979 | Travis | 229/15 |
| 4,148,428 | 4/1979 | Gardner | 229/15 |

*Primary Examiner*—Davis T. Moorhead

*Attorney, Agent, or Firm*—Richard W. Carpenter

[57] ABSTRACT

A heavy duty internal partition formed from a paperboard tube.

3 Claims, 4 Drawing Figures

HEAVY DUTY PARTITION

SUMMARY OF THE INVENTION

This invention relates to internal partition structures of the type used within outer containers or wrappers.

It is an object of the invention to provide a partition of the type described which is formed from a paperboard tube.

A more specific object of the invention is the provision of a partition formed from a paperboard tube and having a double ply central wall with a novel gusset construction joining the ends of the central wall to the side walls to facilitate erection of the partition from a tubular condition.

These and other objects of the invention will be apparent from an examination of the following description and drawings.

THE DRAWINGS

It will be understood that, for purposes of clarity, certain elements may have been intentionally omitted from certain views where they are believed to be illustrated to better advantage in other views.

DESCRIPTION OF THE INVENTION

Figure 1:
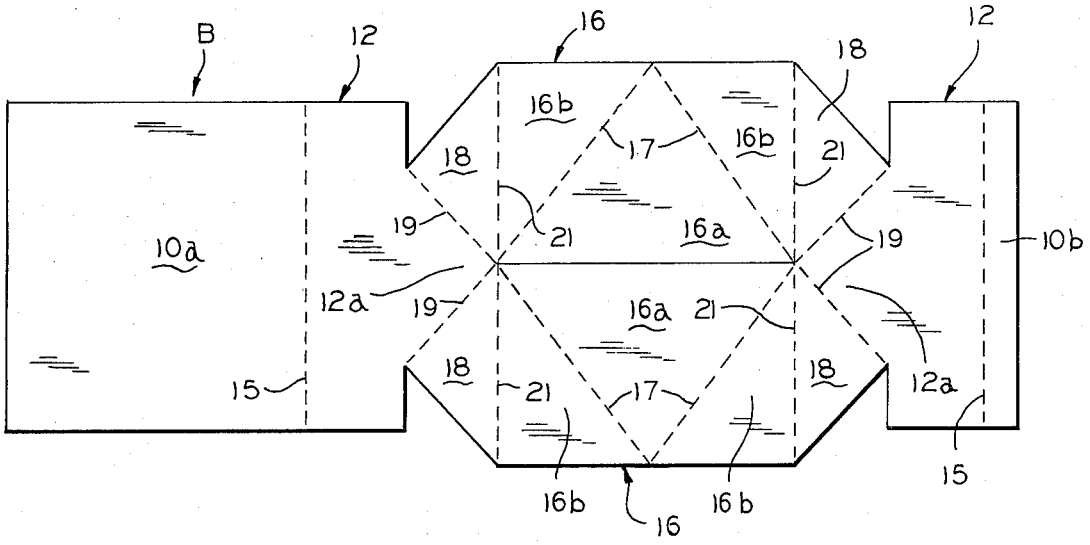
FIG. 1 is a plan view of a blank of foldable sheet material from which the partition, embodying features of the invention and illustrated in the other views, may be formed.
Figure 4:
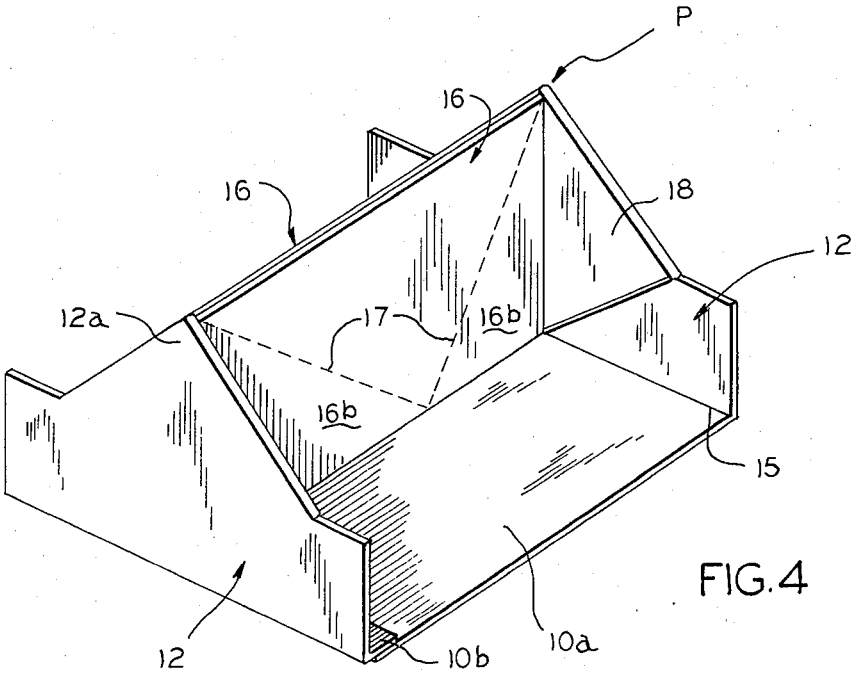
FIG. 4 is a perspective view of a partition shown in the erected condition.

Referring now to the drawings for a better understanding of the invention, it will be seen that the novel partition, indicated generally at P in FIG. 4, may be formed from a unitary blank B of a foldable paperboard illustrated in FIG. 1. One of the novel features of the invention is the construction which permits the blank to be formed into a tube by the manufacturer and shipped to the user who can then easily and quickly form the partition from the tubular structure.

The partition includes a bottom wall 10 which consists of a main panel 10*a* and a flap 10*b* which may be secured to each other to form a manufacturer's joint in any desired manner such as by glue, staples, or stitching.

In addition to bottom wall 10, the partition includes a pair of side walls 12 and a center wall 14 extending normally between medial portions of the side walls.

Each of the side walls 12 includes an upper portion or extension 12*a* which has upwardly converging edges. Side walls 12 have their lower edges foldably joined along fold lines 15 to opposed side edges of bottom wall panels 10*a* and 10*b*, respectively.

The center wall 14 of the partition preferably includes a pair of main panels 16, each having a central portion 16*a* and a pair of side portions 16*b* separated from the central portion by a pair of converging fold lines 17.

The ends of center wall 14 are foldably joined to opposed side walls 12 by means of gussets 18.

Gussets 18 are preferably triangular in shape and are foldably joined to adjacent upper converging edges of related end walls 12 along fold lines 19 and are foldably joined at other edges along fold lines 21 to adjacent side portions 16*b* of related center wall panels 16. Thus it will be appreciated that side wall portions 16*b* and gussets 18 cooperate to form a bellows action permitting the partition to be assembled from a tubular structure in a manner hereinafter described.

Figure 2:
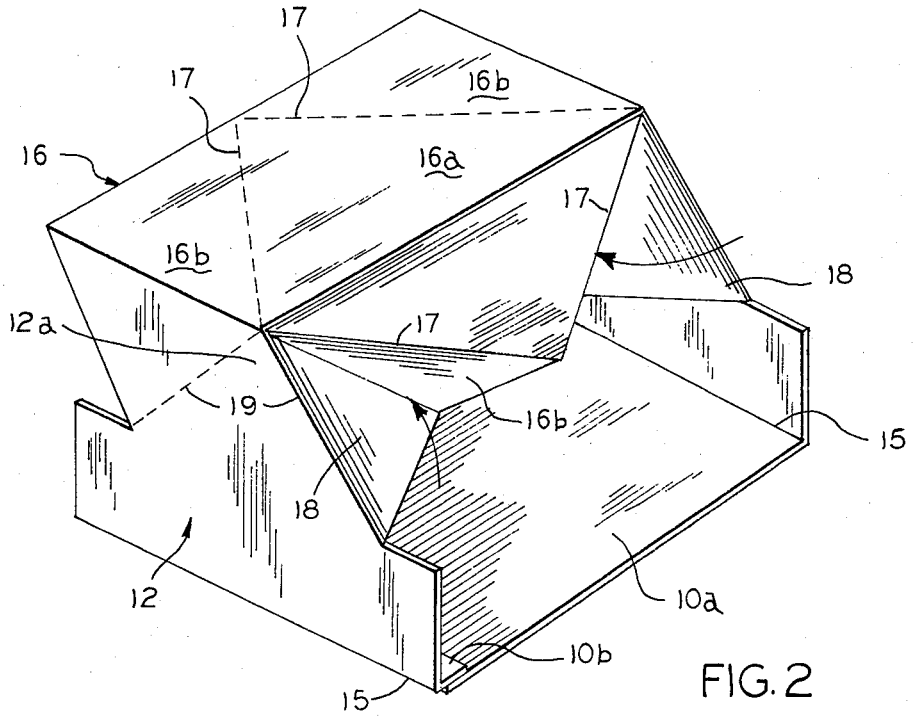
FIGS. 2 and 3 are perspective views illustrating the manner in which the partition is erected.
Figure 3:
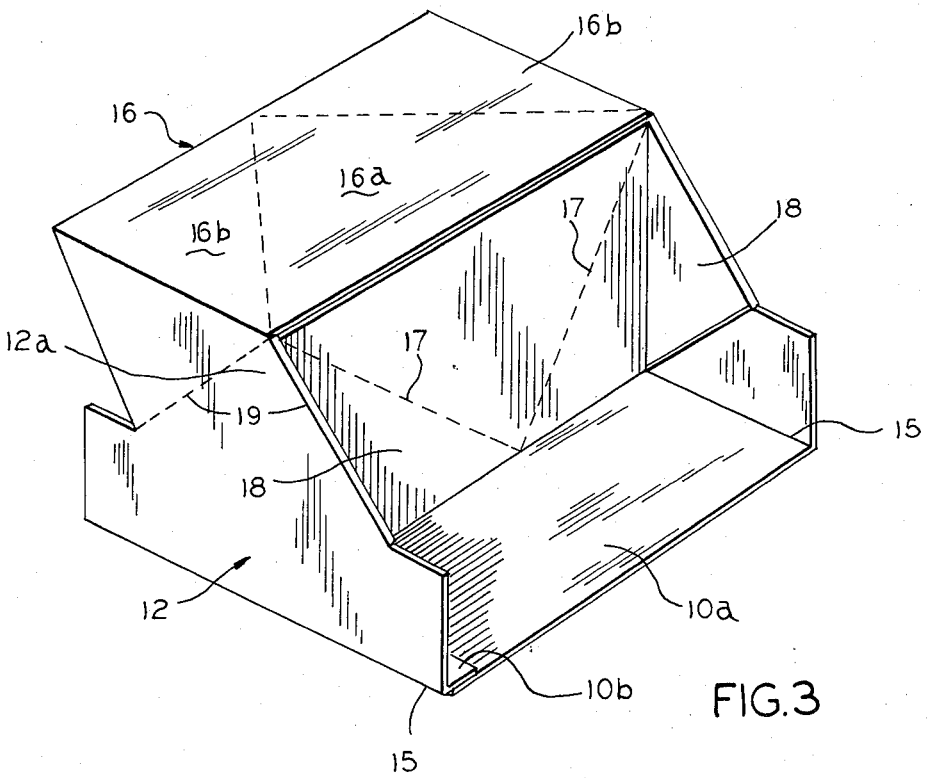

To assemble the partition, after the blank has been formed into a tubular structure, the central portions of the edges of central wall panel 16 are held in position while the side portions 16*b* and related gussets 18 are pushed inwardly, as shown in FIG. 2, to permit the gussets to be folded into face-to-face relation with the inside surfaces of adjacent side walls 12.

At the same time this is being done, central portion 16*a* of each panel is pushed inwardly to assume a vertical position normal to the bottom wall and the side walls whereby side portions 16*b*, which in effect served as gussets and cooperate with gussets 18 for the assembly, now are each folded back into the plane of the related central portion.

Thus, it will be seen that the invention provides a rigid, heavy duty partition which, because of the novel gusset arrangement, can be formed from a tubular structure.

I claim:

1. A heavy duty partition, formed of a unitary tube of foldable paperboard, for use within an outer container or wrapper, comprising:

(a) a bottom wall;

(b) a pair of opposed side walls foldably joined at their lower edges to opposed side edges of said bottom wall and upstanding therefrom;

(c) each of said side walls presenting a pair of upwardly converging edges;

(d) a central wall extending normally between said side walls and including a pair of panels disposed in face-to-face relation which each other;

(e) gusset means foldably joining opposed ends of each of said central wall panels to adjacent converging edges of related side walls;

(f) each of said gusset means including a pair of generally triangular gusset elements foldably joined to each other with:

(i) one of said gusset elements being foldably joined to an adjacent converging edge of a related side wall and disposed in face-to-face relation therewith;

(ii) the other of said gusset elements being formed from material of a related central wall panel and being foldably joined thereto along a diagonal fold line to accommodate the erection of said partition from said tube.

2. A heavy duty partition, formed of a unitary tube of foldable paperboard, for use within an outer container or wrapper, comprising:

(a) a bottom wall;

(b) a pair of opposed side walls foldably joined at their lower edges to opposed side edges of said bottom wall and upstanding therefrom;

(c) each of said side walls presenting at least one upwardly sloping edge;

(d) a central wall panel extending normally between said side walls;

(e) gusset means foldably joining opposed ends of said central wall panel to adjacent sloping edges of related side walls;

(f) each of said gusset means including a pair of generally triangular gusset elements foldably joined to each other with:

(i) one of said gusset elements being foldably joined to an adjacent sloping edge of a related side wall and disposed in face-to-face relation therewith;

(ii) the other of said gusset elements being formed from material of said central wall panel and being foldably joined thereto along a diagonal fold line to accommodate the erection of said partition from said tube.

3. A structure, for retaining or displaying articles, formed of a unitary tube of foldable paperboard, comprising:

(a) a base wall;

(b) a pair of opposed side walls foldably joined at corresponding edges to opposed side edges of said base wall and extending therefrom;

(c) each of said side walls presenting at least one sloping edge;

(d) a panel extending normally between said side walls;

(e) gusset means foldably joining opposed ends of said panel to adjacent sloping edges of related side walls;

(f) each of said gusset means including a pair of generally triangular gusset elements foldably joined to each other with:

(i) one of said gusset elements being foldably joined to an adjacent sloping edge of a related side wall and disposed in face-to-face relation therewith;

(ii) the other of said gusset elements being formed from material of said panel and being foldably joined thereto along a diagonal fold line to accommodate the erection of said structure from said tube.

* * * * *